United States Patent [19]

Gentes et al.

[11] Patent Number: 4,903,350

[45] Date of Patent: Feb. 27, 1990

[54] AERODYNAMICALLY STREAMLINED BICYCLE RACING HELMET

[75] Inventors: James J. Gentes, Soquel; Steven K. Sasaki, Santa Cruz, both of Calif.

[73] Assignee: Giro Sport Design, Inc., Santa Cruz, Calif.

[21] Appl. No.: 212,749

[22] Filed: Jun. 28, 1988

[51] Int. Cl.[4] ..... A42B 7/00; A63B 71/10

[52]. U.S. Cl. ..... 2/421; 2/425

[58] Field of Search ..... 2/4, 171.3, 171.4, 181.8, 2/182.5, 184.5, 410, 414, 421, 425

[56] References Cited

U.S. PATENT DOCUMENTS

| | | | |
|---|---|---|---|
| D. 293,496 | 12/1987 | Gentes | D29/12 |
| 2,846,683 | 8/1958 | Dye et al. | 2/421 |
| 3,925,821 | 12/1975 | Lewicki | 2/425 |
| 4,044,400 | 8/1977 | Lewicki et al. | 2/421 |
| 4,434,514 | 3/1984 | Sundahl et al. | 2/425 |
| 4,653,123 | 3/1987 | Broersma | 2/425 |
| 4,741,054 | 5/1988 | Mattes | 2/421 |

FOREIGN PATENT DOCUMENTS

| | | | |
|---|---|---|---|
| 1141102 | 2/1983 | Canada | 2/4 |
| 581906 | 10/1924 | France | 2/421 |

*Primary Examiner*—Wm. Carter Reynolds

*Attorney, Agent, or Firm*—Rosenblum, Parish & Bacigalupi

[57] ABSTRACT

An aerodynamically streamlined bicycle racing helmet has a molded, plastic helmet body having an exterior shape which is streamlined to provide minimum resistance to frontal airflow. Downwardly extending ribs are formed in the interior surface to define channels for airflow to pass through the interior of the helmet. The rearward portions of the ribs of the helmet are extended downward beneath the lower edge of the helmet to insure that such airflow is not blocked by the back of the user. A pair of strap loops are also attached to the front and upper rear portions of the helmet and form a chin strap which is used to retain the helmet snugly in place upon the head of the user. The attachment points of the straps are specifically selected so that the sides of the strap engage the user's head and prevent tilting of the helmet when it is in use. The helmet may also be provided with a stretch cap with an airflow opening, which allows selection of exterior color, striping or other ornamentation.

18 Claims, 3 Drawing Sheets

AERODYNAMICALLY STREAMLINED BICYCLE RACING HELMET

BACKGROUND OF THE INVENTION

1. Field of the Invention

The present invention relates generally to protective helmets for bicycle riders and more particularly, to an aerodynamically streamlined bicycle racing helmet.

2. Description of the Prior Art

Bicycle racing helmets have long been used by serious racers, and the designs of such helmets have evolved over a number of years in an attempt to improve the weight, safety and aerodynamic drag characteristics. It goes without saying that one of the principle reasons for wearing any helmet at all is for protection of the head to prevent injury in the case of a fall. It is also important that the weight of all rider clothing and protection equipment be reduced to an absolute minimum, and in the case of the helmet, this is particularly true because of the strain placed upon the neck of the user in supporting the helmet during long rides.

Furthermore, in considering the aerodynamics of the helmet, it is important not only that drag be reduced to an absolute minimum, but that adequate ventilation be provided to the user's head.

Still another important consideration that must be taken into account is the manner in which the helmet is attached to the user's head so as to prevent movement relative to the head during use. Heretofore it has been common to use simple strap attachment mechanisms that normally pull the helmet directly down upon the top of the head. However, it has been found that in the case of streamlined helmets such attachment is not adequate and improvements are necessary.

One prior art helmet of the streamlined category is that disclosed in applicant James J. Gentes', U.S. Pat. No. D. 293,496 issued Dec. 29, 1987. The present invention is an improvement of such helmet.

OBJECTS OF THE INVENTION

A primary objective of the present invention is to provide a novel bicycle racing helmet which is aerodynamically streamlined, lightweight and allows a sufficient cooling flow of air to pass between the user's head and the inside of the helmet.

Another object of the present invention is to provide a helmet of the type described having improved strapping design to insure a minimum of movement between the helmet and the user's head.

Still another object of the present invention is to provide a bicycle racing helmet of the type described having means for insuring that the passage of cooling airflow between the helmet and the user's head is not impeded as the user extends his body forward.

Briefly, a preferred embodiment of the present invention includes a molded, plastic helmet body having an exterior shape which is streamlined to provide minimum resistance to frontal airflow. The embodiment further includes downwardly extending ribs formed in the interior surface to define channels for airflow to pass through the interior of the helmet. The rearward portions of the ribs of the present embodiment are extended downward beneath the lower edge of the helmet to insure that such airflow is not blocked by the back of the user. A pair of strap loops are also attached to the front and upper rear portion of the helmet and form a chin strap which is used to retain the helmet snugly in place upon the head of the user. The attachment points are specifically selected so that the sides of the strap engage the user's head and prevent tilting of the helmet when it is in use. As an addition, the helmet may also be provided with a stretch cap which allows selection of exterior color, striping or other ornamentation.

An important advantage of the present invention is that it provides a lightweight racing helmet having optimal streamlining and provision for cooling airflow over the head of the user.

Another advantage of the present invention is that it provides a novel strap location and attachment which facilitates the securing of the helmet in fixed position relative to the user's head.

These and other objects and advantages of the present invention will no doubt become apparent to those of ordinary skill in the art after having read the following detailed description of the preferred embodiments illustrated in the several figures of the drawing.

IN THE DRAWING

DETAILED DESCRIPTION OF THE PREFERRED EMBODIMENT

Figure 1:
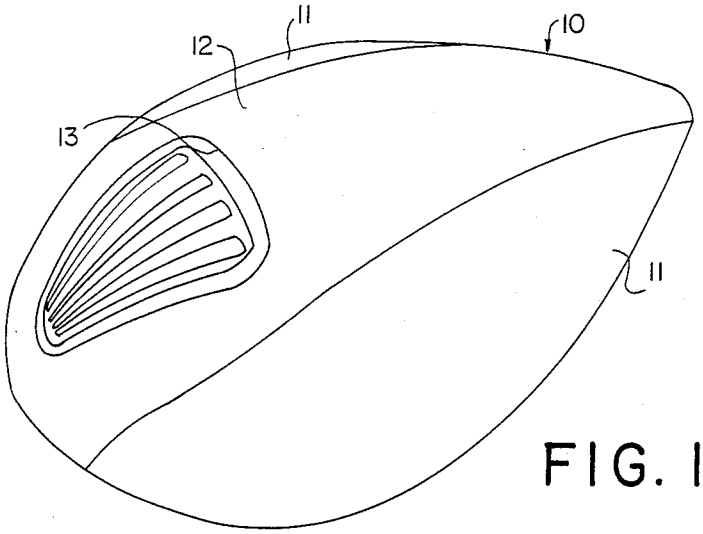
FIG. 1 is a perspective view showing a streamlined bicycle helmet having a stretch cap covering the outside surface in accordance with the present invention.

Referring now to FIG. 1 of the drawing, a presently preferred embodiment of the present invention is shown in perspective view with a cap 10 of stretchable fabric fitted thereover. The cap 10 typically includes side panels 11 of a first color and a center panel 12 of a contrasting second color. An opening 13 is provided in the front of cap 10 to allow cooling air to flow into inlet passages 28 as will be described in more detail below. Not shown is an elastic band provided around the lower perimeter of cap 10 to hold it tightly in place on the helmet.

Figure 2:
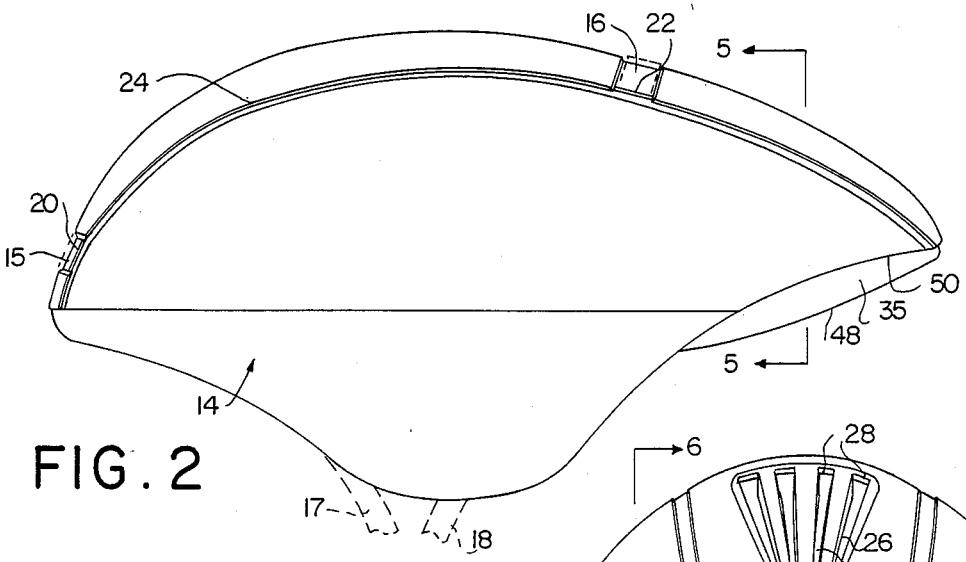
FIG. 2 is a left side elevational view thereof with the covering cap removed.
Figure 3:
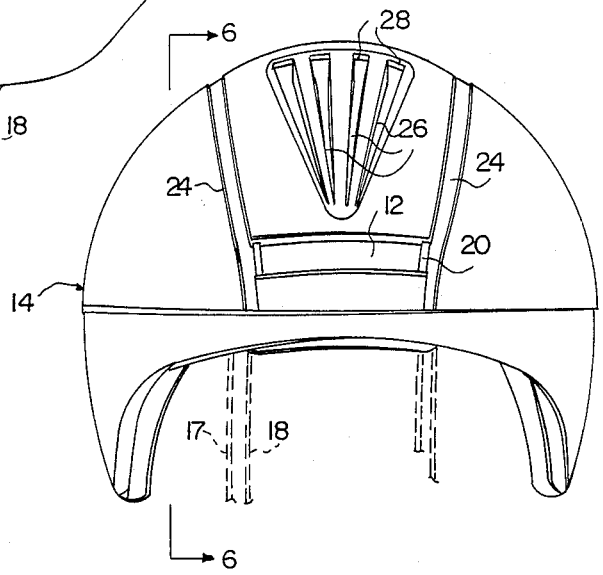
FIG. 3 is a front elevational view thereof.
Figure 4:
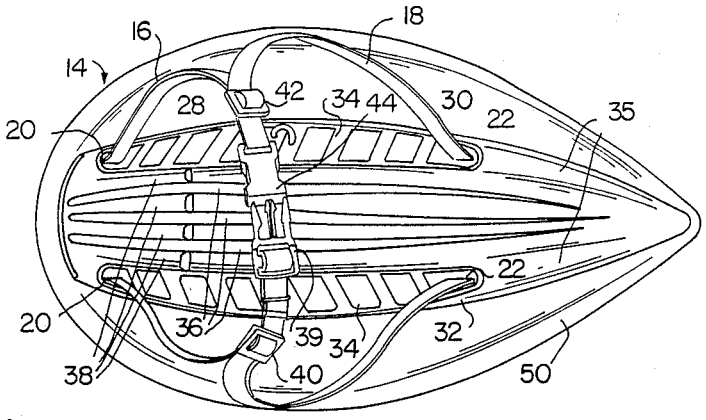
FIG. 4 is a bottom plan view thereof showing the straps and internal details of the preferred embodiment.

The helmet per se is depicted in left-side elevation, front elevation and bottom plan views in FIGS. 2–4 respectively. More particularly, helmet 14 is preferably a molded plastic body made of expanded polystyrene foam and includes a generally oval shaped front portion tapered generally to a point at the rear (as viewed in the plan view of FIG. 4). As depicted in FIGS. 2 and 3, extending across the upper mid-section at the front and top are depressed surface areas or slots 15 and 16 for receiving the straps 17 and 18 respectively, as shown in dashed lines of FIG. 2 and 3, and in solid lines in FIG. 4. At each end of slots 15 and 16, openings 20 extend through the thickness of the helmet so that the straps 17 and 18 may be passed to the interior portion thereof. Extending along the top of each side of helmet 14 is a pair of decorative grooves 24. At the front of the helmet four tapered grooves 26 are provided in fanned array and terminate in openings 28 that form air passageways into the interior of the helmet.

Referring now to FIG. 4 of the drawing, it will be noted that helmet 14 is formed to have a relatively thin outer shell with five centrally disposed ribs extending front to back along the upper interior surface. The forward most portions of outer ribs 30 and 32 are formed and depressed somewhat to receive relatively fit strips 34 which are intended to engage the user's head. The three interior ribs 36 form air flow directing channels 38 which extend from the front of the helmet to approximately the rear. Note that the air passages 28 are aligned with and intercept channels 38.

Straps 17 and 18 are formed of a single length of material, one end of which is attached to a male attachment bracket 39. The strap is passed through a buckle 40 and extended through an opening 20 to the outer surface and then back through the other opening 20 to the interior of the helmet and through a second buckle 42 after which it is looped around a female attachment bracket 44 and returned through buckle 42 for subsequent passage through the slots 22 and then returned through buckle 40 so that the other end may likewise be attached to the male portion of an attachment bracket 39.

Figure 5:
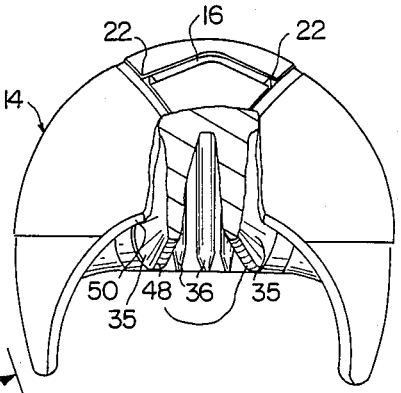
FIG. 5 is a rear elevational view thereof partially broken along the line 4—4 of FIG. 2 to further illustrate structural details.
Figure 6:
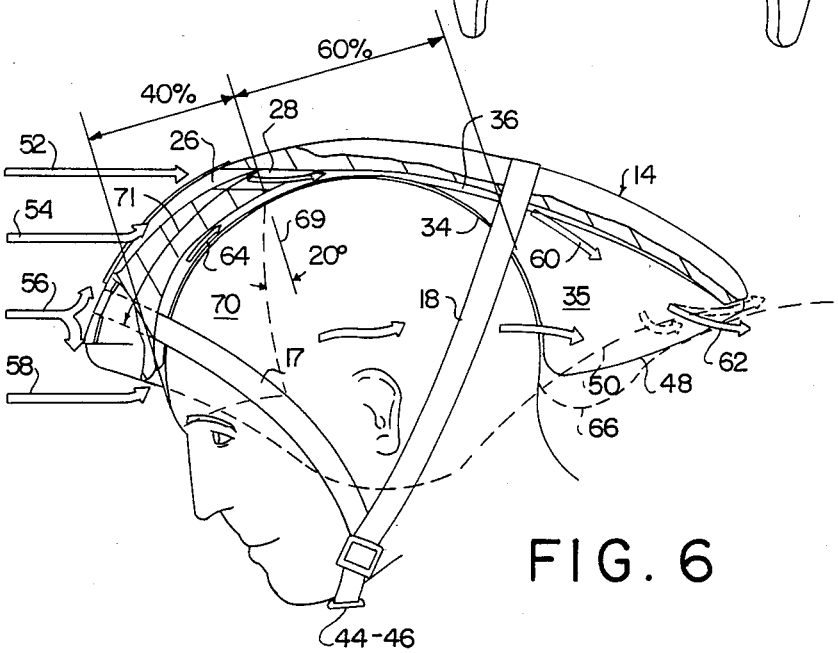
FIG. 6 is a partially broken side elevation illustrating a preferred location of front and rear straps and the manner in which the straps are used to affix the helmet to the head of the user.

In order to further illustrate the shape of the aft portions 35 of the ribs 30 and 32, reference is made to FIG. 5 which is a rear elevation partially broken along the line 5—5 of FIG. 2. Note that the portion 35 extends downwardly to terminate in lower extremities 48 which are positioned beneath the lower edge 50 of the helmet shell (see FIG. 2). In FIG. 6 the shape of rib portions 35 are further depicted.

In use helmet 10 is mounted to the user's head as illustrated in FIG. 6 and straps 17 and 18 are passed around the head and held in engagement therewith by the clip 44–46. Note that as airflow engages the front of helmet 10, as depicted by the four flow arrows 52–58, the flow indicated by arrows 52 and 54 passes along the slots 26 and through the passageways 28 into the interior of the helmet, and thence, passes along the passages 38 (FIG. 4) formed by ribs 36, and thence as indicated by arrows 60 and 62, passes along side rib portions 35 and exits as indicated by the arrow 62.

Air striking the lower frontal portion of the helmet, as indicated by arrow 56, is split to flow either around or up and down and air passing beneath the lower front edge of the helmet passes between the user's forehead and either around the user's head on the sides and between the helmet shell to exit at the rear, or around the top front of his head as indicated by arrow 64 which illustrates passage through the channels 38 as illustrated in FIG. 4.

Note that since the lower extremities 48 of ribs 35 extend beneath the lower edges 50 of the helmet outer shell at the rear, even if the helmet engages the back of the rider (dashed line 66) as he extends his body forward, the protruding ribs 35 will engage his back and maintain the helmet edges 50 clear thereof so as to allow venting of the cooling airflow across and around the user's head.

It has been found that the positioning of front strap 17 is suitable if it is so located as to engage the forward 40% of the user's head. This forward portion of the user's head is defined as the area 70. Area 70 is forward of the transverse plane indicated by the line 69 bisecting the user's head forward of the user's ears and substantially parallel to a forward plane indicated by the line 72 tangent to a midpoint 73 of the user's forehead. Hence, the front strap 17 engages the user's head at points above the eyebrows and forward of an arced line 74 extending approximately 20 degrees forward from the transverse plane 69.

In other words, in accordance with the present invention, the opening 20 (and slot 15) may be positioned anywhere along the arc 71 such that the strap 17 engages the user's head within the area 70. This will insure that the helmet will be firmly held in place.

In accordance with the present invention, any suitable number of interval ribs 30–36 may be combined with an appropriate number of openings 28 to provide air flow around the top of the user's head.

Figure 7:
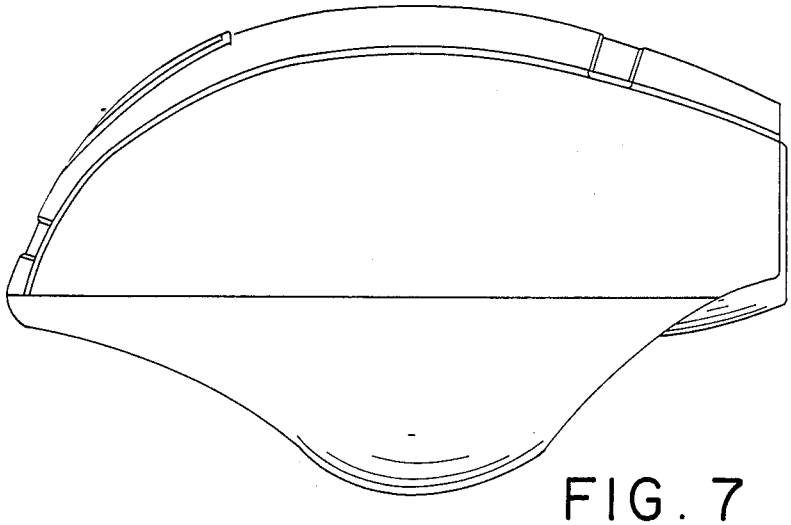
FIG. 7 is an alternative embodiment of the present invention modified by clipping the tail portion thereof.
Figure 8:
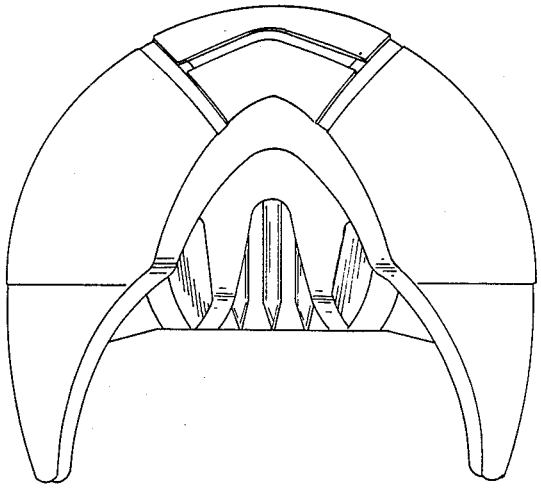
FIG. 8 is a rear elevation view thereof.

In FIGS. 7 and 8 an alternative embodiment is shown which is identical in all respects to the two previously described embodiments except that its tail has been bobbed so that the overall length falls within international racing rules limitations.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A streamlined bicycle helmet comprising:

a molded body having a cavity formed in the lower portion thereof for receiving a user's head, at least two ribs protruding from the interior surface of said body into said cavity to form at least one passage for air to flow between the user's head and said body, and at least one aperture formed in a front portion of said body for admitting air therethrough to said passage;

chin strap means including a front strap affixed to said front portion of said body and adapted to engage a forward portion of the user's head as it passes from the points of attachment to said body to a fastening means proximate the user's chin, and a rear strap affixed to an aft portion of said body and adapted to pass from the points of attachment to said body to points of attachment with said front strap; and a cap for placement over the exterior surface of said body, said cap including at least one opening corresponding to the position of said aperture for admitting air therethrough to said passage.

2. A streamlined bicycle helmet as recited in claim 1, wherein said front strap and said rear strap are both formed from a single continuous length of material.

3. A streamlined bicycle helmet as recited in claim 1, wherein said cap is formed from at least two side panels and a center panel of stretchable material.

4. A streamlined bicycle helmet as recited in claim 1, wherein said front portion is generally oval in shape and said aft portion tapers toward the rear of said body in streamlined fashion.

5. A streamlined bicycle helmet as recited in claim 4, wherein the streamlined taper of said aft portion is bobbed.

6. A streamlined bicycle helmet as recited in claim 4, wherein said body includes at least two of said ribs extending downwardly from said aft portion of said body past the exterior surface of said body and out of said cavity to assure the flow of air through said passage when the user's back comes into contact with said aft portion.

7. A streamlined bicycle helmet as recited in claim 1, wherein said forward portion of said user's head is defined as the area forward of a transverse plane bisecting said user's head forward of said user's ears and substantially parallel to a forward plane tangent to a midpoint of said user's forehead, and wherein said front strap is adapted to engage said user's head at points above said user's eyebrows and forward of an arced line extending approximately 20 degrees forward from said transverse plane.

8. A streamlined bicycle helmet as recited in claim 7, wherein said front strap and said rear strap are both formed from a single length of material.

9. A streamlined bicycle helmet as recited in claim 1, wherein said ribs extend substantially from the front edge of said body to a rear edge of said body to allow air to pass beneath said front edge of said helmet and along the interior surface and passage of said body toward said rear edge.

10. A streamlined bicycle helmet as recited in claim 9, wherein said ribs are integrally formed from said molded body.

11. A streamlined bicycle helmet as recited in claim 1, wherein at least two of said ribs extend downwardly from said aft portion of said body past the exterior surface of said body and out of said cavity to assure smooth air flow through said air passage.

12. A streamlined bicycle helmet, comprising:

a molded plastic body which is generally oval in shape at a front portion of said body and is tapered toward a rear portion of said body in streamlined fashion, said body including a cavity formed in the lower portion thereof for receiving a user's head, at least two ribs protruding from the interior surface of said body into said cavity to form at least one passage for air to flow between the user's head and said body, and at least one aperture in said front portion for facilitating the flow of air therethrough to said passage;

chin strap means including a front strap affixed to said front portion of said body and adapted to engage a forward portion of the user's head as it passes from the points of attachment to said body to a fastening means proximate the user's chin, and a rear strap affixed, to said rear portion of said body and adapted to engage a rearward portion of the user's head as it passes from the points of attachment to said body to points of attachment with said front strap; and a stretchable fabric cap fitted over the exterior surface of said body and having at least one opening therein corresponding to the position of said aperture.

13. A streamlined bicycle helmet as recited in claim 12, wherein said front strap and said rear strap are both formed from a single length of material.

14. A streamlined bicycle helmet as recited in claim 12, wherein said forward portion of said user's head is defined as the area forward of a transverse plane bisecting said user's head forward of said user's ears and substantially parallel to a forward plane tangent to a midpoint of said user's forehead, and wherein said front strap is adapted to engage said user's head at points above said user's eyebrows and forward of an arced line extending approximately 20 degrees forward from said transverse plane.

15. A streamlined bicycle helmet as recited in claim 12, wherein said cap is formed from two side panels of fabric positioned on either side of a central panel of fabric.

16. A streamlined bicycle helmet as recited in claim 12, wherein at least two of said ribs extend downwardly from said rear portion of said body past the exterior surface of said body and out of said cavity to assure the flow of air through said passage when the user's back comes into contact with either said rear portion or said ribs.

17. A streamlined bicycle helmet as recited in claim 16, wherein the streamlined taper of said rear portion is bobbed to reduce the length of said body without disrupting the flow of air through said passage.

18. A streamlined bicycle helmet as recited in claim 12, wherein said ribs are integrally formed from said molded body and extend substantially from the front edge of said body to a rear edge of said body to allow air to pass beneath said front edge of said helmet and along the interior surface and passage of said body toward said rear edge.

* * * * *